United States Patent [19]

Zung

[11] 4,179,065

[45] Dec. 18, 1979

[54] CIRCULATING AIR BUILDING HEATING SYSTEM

[76] Inventor: Joseph T. Zung, 65 Cedar Grove Rd., Rolla, Mo. 65401

[21] Appl. No.: 921,980

[22] Filed: Jul. 5, 1978

[51] Int. Cl.[2] ..... F24B 7/02

[52] U.S. Cl. ..... 237/51; 126/63; 126/121

[58] Field of Search ..... 237/51; 126/121, 122, 126/63, 120, 77, 110 B

[56] References Cited

U.S. PATENT DOCUMENTS

| | | | |
|---|---|---|---|
| 2,231,258 | 2/1941 | Elmore | 237/51 |
| 2,333,146 | 11/1943 | Beyer | 126/121 |
| 3,664,325 | 5/1972 | Malafouris | 126/121 |
| 3,724,443 | 4/1973 | Carson | 126/121 |
| 4,059,090 | 11/1977 | Shaw | 126/121 |
| 4,074,679 | 2/1978 | Jensen | 126/131 X |
| 4,096,849 | 6/1978 | Moncrieff-Yates | 126/121 |
| 4,111,181 | 9/1978 | Canney | 126/77 |

FOREIGN PATENT DOCUMENTS

| | | | |
|---|---|---|---|
| 452774 | 8/1936 | United Kingdom | 126/121 |

*Primary Examiner*—William E. Wayne
*Assistant Examiner*—William E. Tapolcai, Jr.
*Attorney, Agent, or Firm*—Garrettson Ellis

[57] ABSTRACT

A circulating air building temperature control system includes a pumped air circulation conduit for distributing controlled temperature air throughout the building and collecting return air, and a fireplace for burning solid fuel, the air circulation conduit being positioned about the exterior of the fireplace chamber walls and sealed from the fireplace chamber. An outer housing is also provided to define an outer chamber positioned about the air circulation conduit, and connected to air inlets and outlets to limit the upper temperature of the outer housing wall even in the event of a hot fire and no circulation through the air circulation conduit.

8 Claims, 7 Drawing Figures

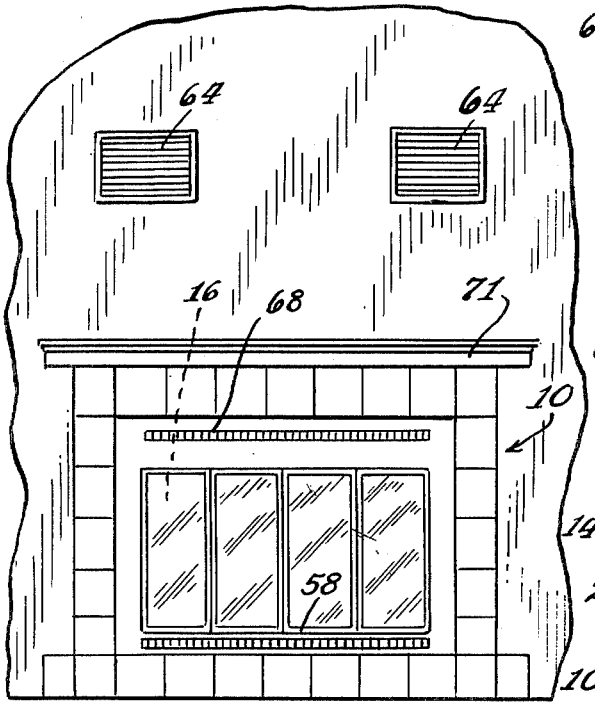
Fig. 1
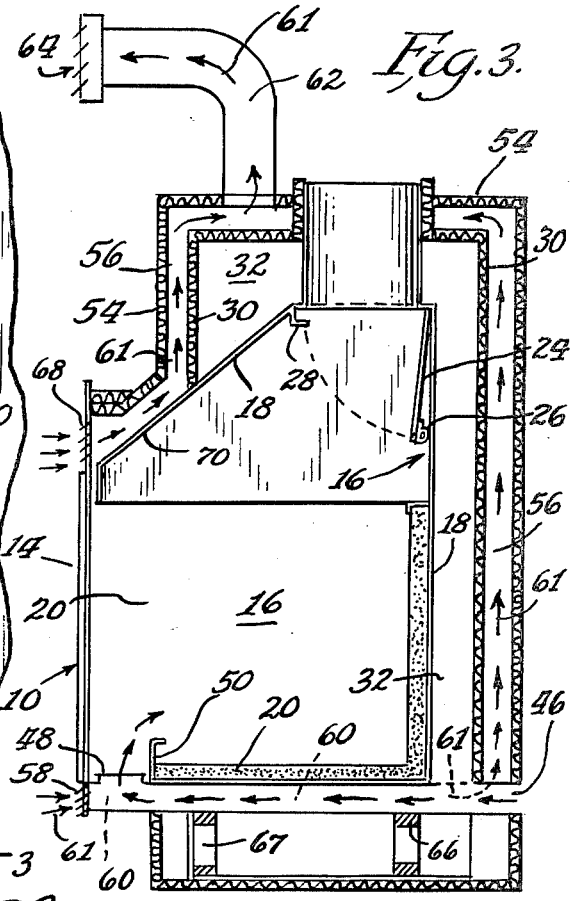
Fig. 3.
Fig. 2.
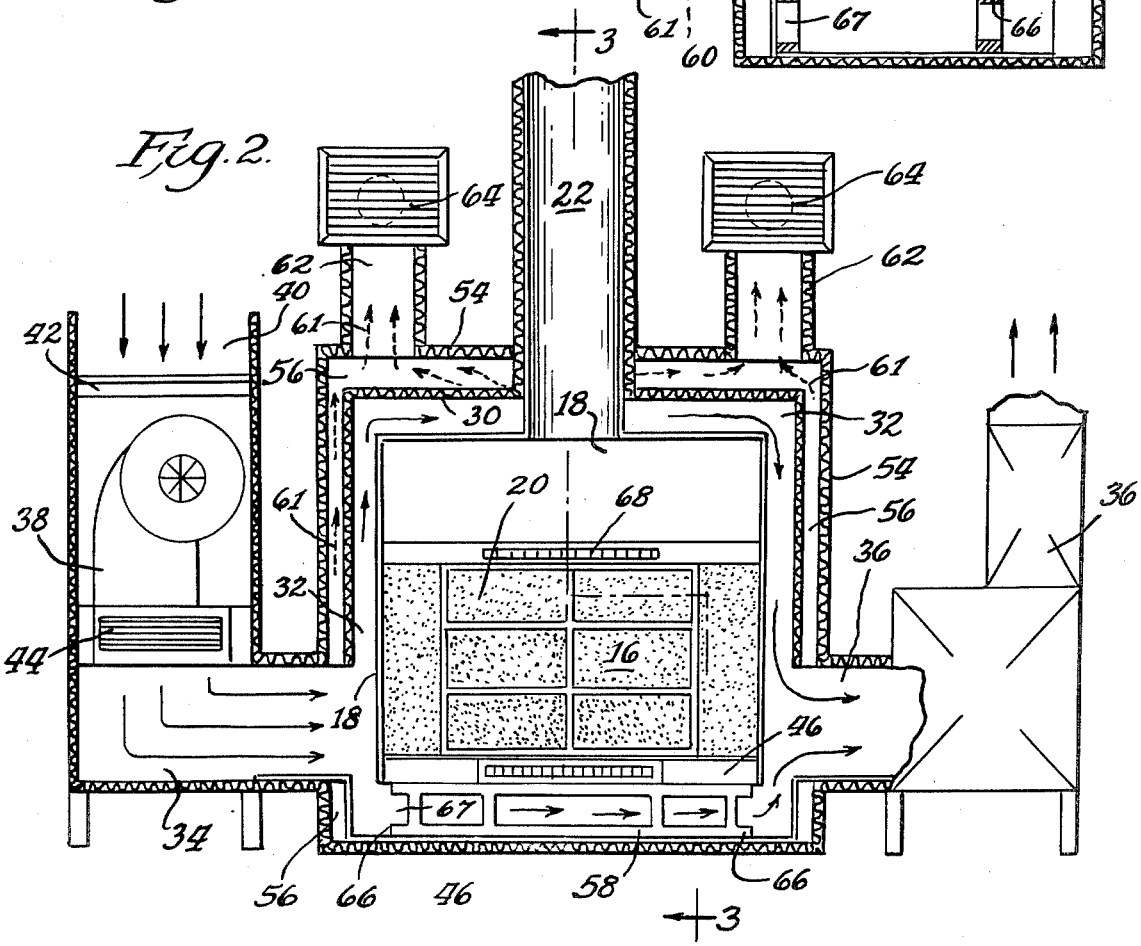

64
62
22
68
54
36
14
12
58

62
54
22

20
18
54
32
16
56
18
50
60
48
46
67
20
66
46

CIRCULATING AIR BUILDING HEATING SYSTEM

BACKGROUND OF THE INVENTION

In U.S. Pat. No. 4,004,731 means is shown for circulating the heat from a fireplace to the circulating air plenum of a central heating system of a house or the like. Accordingly, in the event of fuel shortage, auxiliary wood or coal can be burned in the fireplace, and the heat distributed throughout the entire house by the blower motor of the furnace.

Any heating device which is incorporated into a building structure should meet stringent safety requirements, relating, for example, to the maximum permissible temperature of the outer wall of the heater. If the temperature of the outer wall is excessive, a substantial spatial clearance of the heat ducts from the combustible wooden parts of the house should be maintained.

With modern heating devices using gas, oil or electricity, a thermostat can be used to control the temperature. However, a solid fuel fire is not as readily controllable in this manner, although an automatic damper can be used. In the case of an electrical power failure, an automatic damper may cease to function, and the thermostat and blowers will also cease operation, which may result in an excessive temperature increase in the air circulation conduit surrounding the fireplace.

A power failure is, of course, a prime time when one might wish to have a fire in the home, with the result that a fire hazard may be created by an extreme increase of temperature in the duct work adjacent the furnace, in the event that the hot duct is in essential contact with flammable materials.

Accordingly, there is a need for a safe zero-clearance fireplace unit in thermal connection with the house ductwork. By the term "zero-clearance," it is meant that the fireplace unit can be installed in essential contact with flammable materials such as studs in the wall of the house, wallboard, or the like.

One alleged zero-clearance fireplace is illustrated by U.S. Pat. No. 3,888,231. Such a construction has a drastically reduced heat efficiency, since a great amount of the heat transferred through the fireplace walls is dissipated up the chimney flue by a current of cold air drawn from outdoors into the outer chamber of the device to cool it, and to lower the temperature of the skin of the outer housing.

Also, some free-standing stoves have had a double wall construction to attempt to reduce the temperature of the outer wall. However, they still give rise to fire hazards.

In accordance with this invention, a solid fuel furnace is provided which is safe enough to be enclosed into the structure of the building, or even placed inside of a small, closed space such as a closet or a small utility area.

The solid fuel furnace may be in the form of a decorative fireplace, or a central heating furnace in an enclosed part of the house. The apparatus of this invention may be used in combination with another conventional gas, oil, electric, or solar heating device, or a heat pump, as well as an optional air conditioning unit.

DESCRIPTION OF THE INVENTION

In accordance with this invention, a circulating-air building temperature control system is provided, including means defining a pumped air circulation conduit for distributing controlled temperature air throughout the building and collecting return air.

A heating unit is positioned within the air circulation conduit, which comprises a fireplace chamber for burning solid fuel, defined by fireplace chamber walls and means for holding the fuel. Chimney means communicate with the fireplace through the air circulation conduit.

A portion of the air circulation conduit is positioned about the exterior of the fireplace chamber to receive heat through the fireplace chamber walls.

An outer housing defines an outer chamber, and encloses the fireplace chamber and the pumped air circulation conduit portion adjacent the fireplace chamber. Air inlet means are positioned at a lower portion of the outer housing, communicating with the outer chamber. Air outlet means are positioned at an upper portion of the outer housing and communicate between the outer chamber and an indoors location for receiving hot air from the outlet means, to serve as an automatic means for cooling the air circulation conduit portion, while warming the building by the convective circulation of air through the inlet means, outer chamber, and outlet means.

Accordingly, this limits the maximum temperature of the outer housing, even when air is not circulating through the pumped air circulation conduit.

Referring to the drawings, FIG. 1 is an elevational view of a living room fireplace, adapted in accordance with this invention as part of a building temperature control system.

FIG. 2 is a front view of the fireplace of FIG. 1 with the front facing removed.

FIG. 3 is a sectional view, taken along line 3—3 of FIG. 2.

Figure 4:
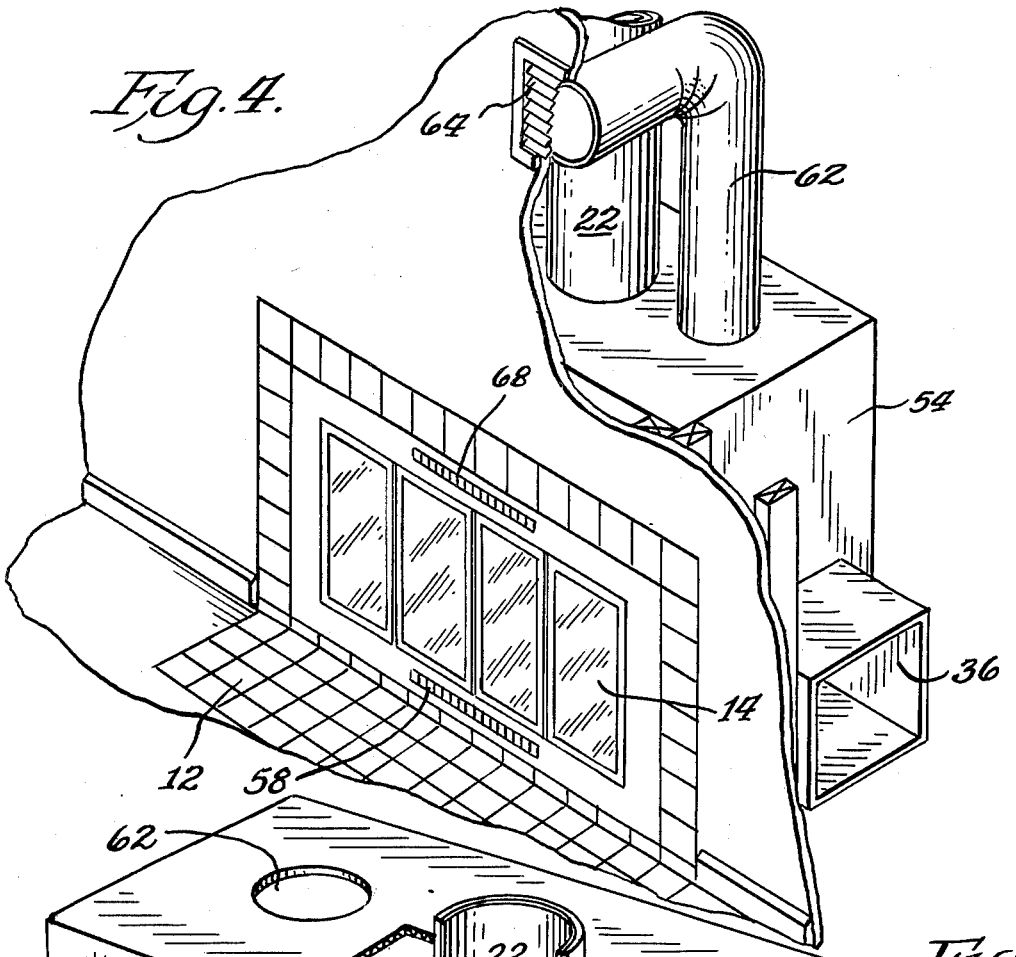
FIG. 4 is a perspective view of the fireplace of the previous figures, with part of the front facing broken away.
Figure 5:
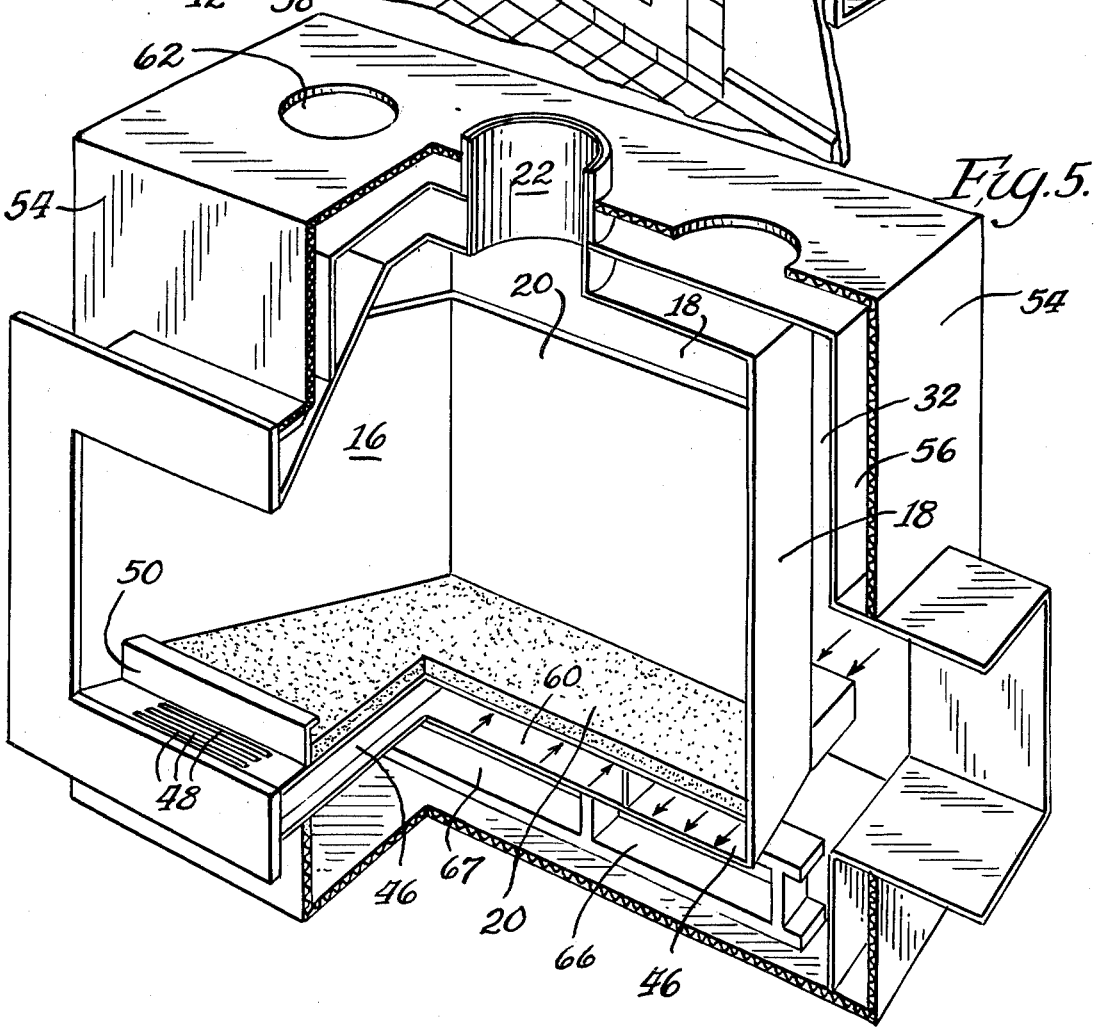
FIG. 5 is a perspective view, with portions removed and broken away, of the fireplace of the previous drawings.

Referring to FIGS. 1 through 5, a fireplace is disclosed, which is in heat-exchange, air flow relation with the forced air plenum of a central heating/cooling system of a modern home. Fireplace 10, which typically may be found in the living room of the home, comprises an outer hearth 12 as shown in FIG. 4, and may optionally have openable and closable glass doors 14. Firebox 16 may be made of sheet metal sections 18 as shown, with an inner section of firebrick 20 attached to the walls of firebox 16 for retaining the actual fire. Chimney 22 is equipped with a hinged flue valve 24, which may swing shut and be locked by manipulation of a conventional lock handle 26 in cleat 28 to close the fireplace when desired.

Firebox 16 is enclosed by metal walls 30 to define a heat exchange chamber 32. An inlet plenum 34 communicates on one side of chamber 32, while an outlet plenum 36 communicates with the other side thereof, the plenums 34, 36 constituting part of the house ductwork for central heating, and optionally air conditioning.

A conventional fan blower 38 is provided in the ductwork in the usual manner, typically upstream of the firebox, to propel air from the cold air return 40, through air filter 42, and past an auxiliary furnace 44, which is shown to be an electric heating unit, but also may appropriately be any gas, oil or solar furnace, or a heat pump, as desired. Also, furnace 44 may be spaced remotely in the ductwork from the firebox 16 if desired.

The pumped air passes through inlet plenum 34 and then flows around the back of firebox 16, and over the top and under the bottom thereof, to be collected in the warm air plenum 36, the air being warmed when a fire is present in firebox 16, for further distribution into the house ductwork.

Air from the exterior can be supplied to the fireplace by a pair of conduits 46, which pass under firebox 16 and provide communication between the outside and a pair of screened apertures 48 at the opposed front sides of the floor of the firebox. Vertical partition 50 extends across a front portion of the firebox to prevent coals and the like from covering the screened apertures 48. One aperture 48 is placed on each front corner of the firebox, and is supplied by a separate air inlet conduit 46.

Accordingly, heat from the fire within firebox 16 is transferred through walls 18 to heat exchange chamber 32, which is in communication with circulating air system of the home. However, in the event that the circulating air system is not operating, due to a power failure or the like, and a hot fire is burning, the temperatures in chamber 32 can be expected to rise to very substantial levels, which could be a fire hazard if the combustible materials were in contact with wall 30.

In accordance with this invention, an outer housing 54 is provided about the inner wall 30. Both housing 54 and inner wall 30 may be made of an insulative, non-inflammable material such as asbestos coated sheeting or the like, to retard the rate of heat transfer through the respective walls.

Outer housing 54 defines an outer chamber 56 which surrounds the inner plenum chamber 32. A lower inlet 58 communicates between outer chamber 56 and the exterior, for example, the room in which the fireplace faces, the communication being by means of conduit 60 which passes under firebox 16 and terminates at the rear of the firebox in outer chamber 56.

At an upper portion of the fireplace of this invention, a pair of conduits 62 communicate between outer chamber 56 and the exterior through vent 64, which typically communicates with the room which the fireplace faces.

Accordingly, even in the event that there is no air circulation through plenum chamber 32 and the temperature rises severely in the event of a hot fire, in outer chamber 56 a spontaneous upward flow of air 61 will begin to take place as heat passes through inner housing wall 30, the air being drawn in through intake 58, and flowing about the exterior of housing wall 30 to an exit back into the room by conduits 62 and outlets 64. This will prevent the temperature of outer housing wall 54 from rising to a dangerous level, which in turn permits the outer housing wall to be placed in close proximity to inflammable materials such as dry wall and wooden parts of the building, resulting in a "zero-clearance" fireplace.

As an added advantage, less of the heat of the fireplace is wasted, since all of the heat passing through the wall of the firebox 16 is either distributed throughout the house through the plenum system 34, 36, or is recirculated into the room through events 64, resulting in a more rapid warming of the room.

Firebox 16 rests upon supports 66, which define apertures 67 as shown to facilitate air circulation through plenum chamber 32.

If desired, added cold room air inlet 68 may communicate from a position above the firebox with outer chamber 56, to reduce the temperature of the forward portion 70 of the upper wall 18 of the firebox. This prevents excessive temperatures from being generated adjacent mantlepiece 71.

Figure 7:
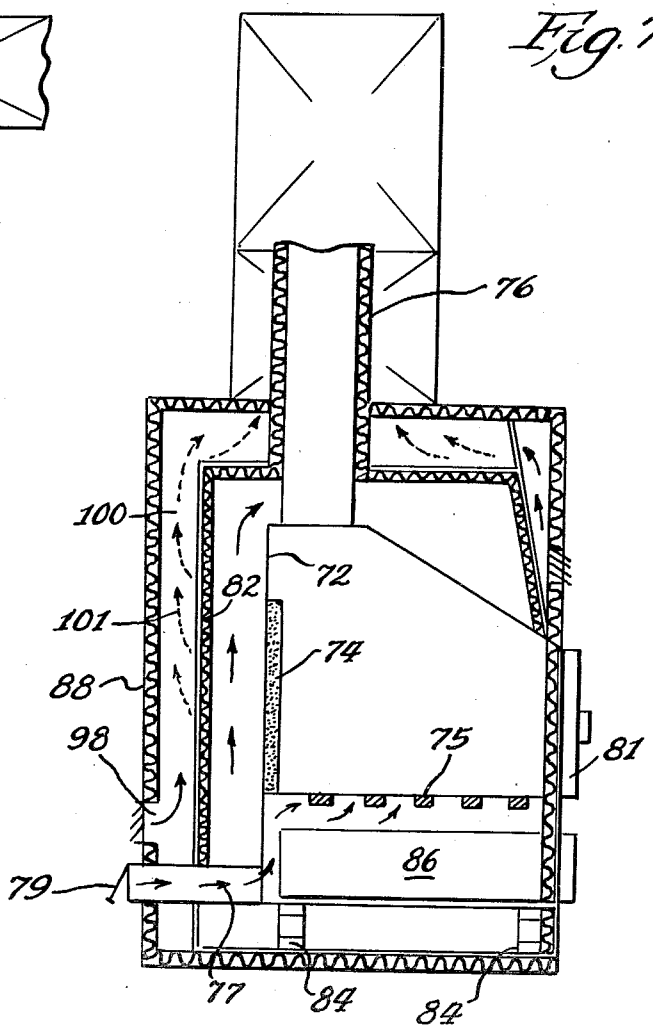
FIG. 7 is a side view, taken partly in vertical section along line 7—7 of FIG. 6.
Figure 6:
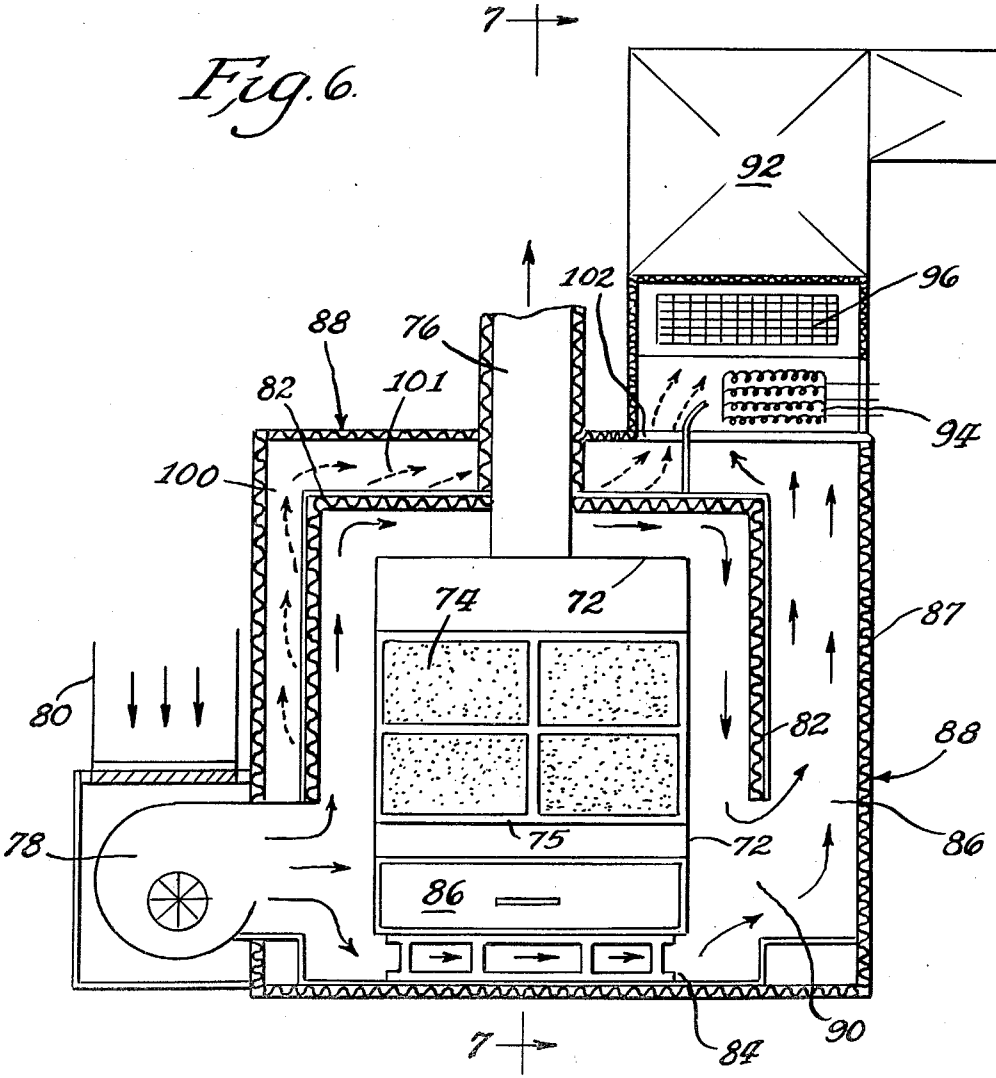
FIG. 6 is a front elevational view, with the front facing broken away, of a furnace made in accordance with this invention.

Referring to FIGS. 6 and 7, a furnace is shown, being adapted in accordance with this invention. Firebox 72 is shown having ceramic tile 74 in the hottest areas, and possessing the usual chimney or flue 76. The fire holding area of firebox 72 is defined by grate 75.

As in the previous embodiment, a fan blower 78 is positioned in an inlet plenum 80, which constitutes the cold air return for firebox 72. An inner housing 82 of insulated wall material such as asbestos-coated steel sheeting is positioned about the upper portion of firebox 72, with firebox 72 being elevated off of the ground by supports 84 of a design similar to the previous embodiment. Removable ashpan 86 is provided in the bottom of firebox 72 for cleaning the furnace.

Outside combustion air is provided to the firebox by means of conduit 77, which may be equipped with an automatic air damper 79 for normal control of the temperature of the firebox.

Door 81 is also provided for access.

At the side of inner housing 82 opposite from inlet plenum 80 an outlet plenum 86 is defined by inner housing 82 and wall 87 of an outer housing 88. Aperture 90 is formed in inner housing 82, to provide flow communication into plenum 86. Plenum 86 leads as shown upwardly into ductwork 92 for distribution of the hot air throughout the house.

Positioned in the ductwork 92 is shown an auxiliary furnace 94, which is specifically seen to be of the electric version. However, it is contemplated that this invention may be utilized in conjunction with other auxiliary heating sources by appropriate modification of the ductwork and the like. An air conditioner cooling coil 96 is also shown to be positioned in the ductwork.

For the purposes as previously described of preventing of overheating of the outer wall of the heating unit of this invention, outer housing 88 comprises walls surrounding the inner housing 82. Both housings 82 and 88 may comprise insulated walls.

One or more room air inlets 98 are provided in this particular embodiment, in communication with the outdoors, or the room in which the furnace stands, to bring air into the outer chamber 100 defined between outer housing 88 and inner housing 82. The air flows by convection, as heat is transferred through inner housing wall 82, with the convection indicated by arrows 101 in FIG. 6 around that portion of inner housing wall 82 which is not in contact with outlet plenum 86. The warmed air flows across the top of inner housing wall 82, through an aperture 102 and also into communication with the ductwork 92 of the home.

Thus, even when the fan blower is not operating, heat will be transferred away from the inner housing wall 82 by convection upwardly throughout outer chamber 100, and into the ductwork 92 of the house, where it can be dissipated. For this reason, this embodiment can be considered a zero-clearance furnace with automatic convection means for dissipating excess heat, to avoid excessive temperature of the outer housing 88.

The above has been offered for illustrative purposes only and is not intended to limit the scope of the invention of this application, which is as defined in the claims below.

That which is claimed is:

1. In a circulating-air building temperature control system including means defining a pumped air circulation conduit for distributing controlled-temperature air throughout the building and collecting return air, and a heating unit positioned within the air circulation conduit comprising a fireplace chamber for burning solid fuel, defined by fireplace chamber walls, a portion of said air circulation conduit being positioned about the exterior of the fireplace chamber walls, chimney means communicating with said fireplace chamber through said air circulation conduit, and an outer housing defining an outer chamber enclosing said fireplace chamber and the pumped air circulation conduit portion adjacent said fireplace chamber, air inlet means positioned at a lower portion of said outer housing and communicating with the outer chamber, and air outlet means positioned at an upper portion of said outer housing and communicating between said outer chamber and an indoors location for receiving hot air from said outlet means, to serve as an automatic means for cooling said air circulation conduit portion while warming the building by the convective circulation of air through said inlet, outer chamber, and outlet, to limit the maximum temperature of said outer housing even when air is not circulating through said pumped air circulation conduit, in which an added air inlet is positioned adjacent said upper portion of said fireplace chamber to direct air along at least a portion of a top wall of said fireplace chamber for removal of heat therefrom, said added air inlet communicating with said air outlet means.

2. The building temperature control system of claim 1 in which said air outlet means communicates directly with the open air of a room in said building.

3. The building temperature control system of claim 1 in which said air outlet means communicates with a portion of said air circulation conduit at a position downstream from the portion of said air circulation conduit which is positioned about the exterior of the fireplace chamber.

4. The building temperature control system of claim 3 in which said pumped air circulation conduit is defined between said fireplace chamber walls and an inner housing, a portion of said inner housing also defining the inner surface of an outlet conduit positioned between said inner housing and said outer housing, which receives air from said portion of the pumped air circulation conduit and leads to said air outlet means, said air outlet means being positioned adjacent an upper portion of said housing.

5. The building temperature control system of claim 1 in which a combustion air conduit communicates between said fireplace chamber and the exterior of said heating unit, said combustion air conduit passing underneath said fireplace chamber in communication with said fireplace chamber at a front location of the bottom wall thereof.

6. The building temperature control system of claim 5 in which a pair of said combustion air conduits are positioned in spaced relation to each other, said air inlet means comprising a conduit defining an air inlet in a front location of said fireplace and passing between the combustion air conduits under the bottom wall of said fireplace into communication with said outer chamber at a lower location thereof.

7. In a circulating-air building temperature control system including means defining a pumped air circulation conduit for distributing controlled temperature air throughout the building and collecting return air, and a heating unit positioned within the air circulation conduit comprising a fireplace chamber for burning solid fuel, defined by the fireplace chamber walls, a portion of said air circulation conduit being positioned about the exterior of the fireplace chamber walls, chimney means communicating with said fireplace chamber through said air circulation conduit, and an outer housing defining an outer chamber and enclosing said fireplace chamber and the pumped air circulation conduit portion adjacent said fireplace chamber, air inlet means positioned at a lower portion of said outer housing and communicating with the outer chamber, and air outlet means positioned at an upper portion of said outer housing and communicating between said outer chamber and an indoors location for receiving hot air from said outlet means, to serve as an automatic means for cooling said air circulation conduit portion while warming the building by convective circulation, and a pair of combustion air conduits communicating between said fireplace chamber and the exterior of said heat unit, said combustion air conduits passing underneath said fireplace chamber in communication with said fireplace chamber at a front location of the bottom wall thereof, said air inlet means comprising a conduit defining an air inlet in a front location of said fireplace chamber and passing between the respective combustion air conduits under the bottom wall of said fireplace chamber into communication with said outer chamber at a lower location thereof in which an added inlet is positioned adjacent said upper portion of said fireplace chamber to direct air along at least a portion of the top wall of said fireplace chamber for removal of heat therefrom, said added air inlet communicating with said air outlet means.

8. The building temperature control system of claim 7 in which said air outlet means communicates directly with the open air of a room in said building.

* * * * *